US006346126B1

(12) United States Patent
Chao et al.

(10) Patent No.: US 6,346,126 B1
(45) Date of Patent: Feb. 12, 2002

(54) ACOUSTIC-ENERGY-ASSISTED REMOVAL OF SOIL FROM FABRIC IN A GASEOUS ENVIRONMENT

(75) Inventors: Sidney C. Chao, Manhattan Beach; Nelson W. Sorbo, Redondo Beach, both of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/453,194

(22) Filed: Dec. 2, 1999

(51) Int. Cl.[7] ..... D06B 3/30

(52) U.S. Cl. ..... 8/149.2; 34/279; 68/3 SS; 68/5 C; 68/13 R

(58) Field of Search ..... 8/149.1, 149.2; 68/3 SS, 5 C, 13 R; 34/260, 261, 279

(56) References Cited

U.S. PATENT DOCUMENTS

| | | | |
|---|---|---|---|
| 2,769,506 | A | 11/1956 | Abboud |
| 2,854,091 | A | 9/1958 | Roberts et al. |
| 2,962,120 | A | 11/1960 | Lagarias |
| 3,053,031 | A | 9/1962 | Vedder et al. |
| 5,486,236 | A | 1/1996 | Townsend et al. |
| 5,651,276 | A | 7/1997 | Purer et al. |

FOREIGN PATENT DOCUMENTS

| | | |
|---|---|---|
| DE | 12 78 981 B | 1/1963 |
| DE | 25 25 443 A | 12/1976 |
| JP | 04 193198 A | 7/1992 |

OTHER PUBLICATIONS

Olsen, Mats, "Sonic Cleaning of Dust Filters", Filtration and Separation, (Nov./Dec. 1974).

Schimmoller, Brian K., "Tuning in to Acoustic Cleaning", Power Engineering (Jul. 1999).

*Primary Examiner*—Philip R. Coe
(74) *Attorney, Agent, or Firm*—Colin M. Raufer; Leonard A. Alkov; Glenn H. Lenzen, Jr.

(57) ABSTRACT

A soiled piece of fabric is cleaned by mechanical agitation while the fabric is simultaneously subjected to acoustic energy in a gaseous environment wherein the piece of fabric is not immersed in a liquid cleaning medium. Mechanical agitation may be by gas jet action and/or by tumbling. The acoustic energy vibrates the fibers of the fabric to enhance the cleaning action. The piece of fabric may be chemically treated to mobilize the soil.

21 Claims, 3 Drawing Sheets

ACOUSTIC-ENERGY-ASSISTED REMOVAL OF SOIL FROM FABRIC IN A GASEOUS ENVIRONMENT

BACKGROUND OF THE INVENTION

This invention relates to the removal of soil from fabric in a gaseous environment, and, more particularly, to the utilization of acoustic energy to improve the dislodging of soil from the fabric and to prevent its redeposition onto the fabric.

The dry cleaning of fabrics is currently performed commercially using organic solvents such as perchloroethylene or petroleum derivatives. These solvents pose a health hazard, are smog-producing, and/or are flammable. As an alternative, U.S. Pat. No. 5,467,492 discloses a dry-cleaning process that uses liquid carbon dioxide as a cleaning medium. This process allows the fabric to be cleaned without the use of undesirable chemicals. One of the disadvantages of this liquid carbon dioxide process is that it must be performed within a pressure system, and thus has associated high capital costs.

In an alternative approach, U.S. Pat. No. 5,651,276 describes an apparatus and method to expel soils from fabric using gas jets in an ambient-pressure environment, without immersion of the fabric in a liquid cleaning medium. In this approach, mechanical agitation is provided by a jet of pressurized gas directed at the soiled fabric. The agitation of the fabric, by the mechanical agitation of the pressurized gas and by other coordinated sources of mechanical agitation such as tumbling, loosens and expels particulate soil from the fabric. The soil is entrained in the gas flow and subsequently filtered from the gas flow. The use of gas jet cleaning resolves the health and environmental concerns posed by conventional solvents. An additional benefit is that its use reduces secondary waste streams associated with processes that employ conventional solvents.

These agitation-based processes for cleaning fabric without immersion in water and without the use of environmentally undesirable chemicals have been demonstrated to be operable. Nevertheless, there is a desire to improve their cleaning effectiveness and efficiency. The present invention provides such an improvement.

SUMMARY OF THE INVENTION

The present invention provides an improvement to the mechanical agitation process for cleaning fabric such as garments. The modified process has an increased effectiveness and efficiency in removing soil from the fabric, and preventing its redeposition on the fabric. The process remains environmentally friendly, inasmuch as no noxious or dangerous chemicals are used, and waste streams are small. The present approach is compatible with the use of other techniques for enhancing the cleaning process. The process is a "dry cleaning" process, and the fabric is not immersed in any liquid cleaning medium during the actual cleaning procedure. The cleaned fabric is dry as it is taken from the cleaning apparatus.

In accordance with the invention, a method for cleaning fabric comprises the steps of providing a piece of fabric having soil therein, providing a source of acoustic energy, and cleaning the piece of fabric in a gaseous environment wherein the piece of fabric is not immersed in a liquid cleaning medium. The step of cleaning includes the steps of subjecting the piece of fabric to acoustic energy emitted from the source of acoustic energy, and, simultaneously, mechanically agitating the piece of fabric. The piece of fabric is preferably mechanically agitated by a jet of a soil-dislodging gas and/or by tumbling. All or a part of the piece of fabric may be treated with a mobilizing chemical that loosens the soil.

The frequency of the acoustic energy may be either in an audible range or at a high acoustic frequency. Typically, the acoustic energy has a frequency of from about 1 hertz up to about 1 megahertz ($10^6$ hertz). This acoustic energy is preferably provided by an acoustic device which converts an electrical input signal into an acoustic output signal. There is typically an electrical source which provides the electrical input signal to the acoustic device. The electrical source may include a controllable function generator which provides the electrical input signal to the acoustic device.

Simultaneously with the subjecting of the fabric to the acoustic energy, it is mechanically agitated by any operable approach. Examples of operable mechanical agitation techniques include gas jet agitation and tumbling agitation. In the first case, the jet of the soil-dislodging gas loosens soil that adheres to the fibers of the fabric, both by direct impingement and by causing flexure in the fabric that frees the soil from the fabric. In the second case, tumbling as in a cylindrical drum causes the fabric to flex, having somewhat the same effect. The acoustic energy creates sympathetic vibrations in the fibers, which aid in and accelerate this loosening and dislodging of the soil from the fabric at the same time that it is mechanically agitated.

The fabric may be treated with safe, environmentally benign chemicals to improve the dislodging process. Such chemicals may serve to loosen particulate soil, or to cause non-particulate soil to become particulated. The chemicals may be generally acting chemicals that are used to treat the entire fabric, or "spotting" chemicals that act on specific types of soil. Such chemicals may be applied either before or during the cleaning operation. Other chemicals such as odorants and anti-static compounds may be introduced during or after the cleaning operation. The chemicals are selected to be environmentally friendly and non-toxic.

This method of the invention is a gaseous approach, accomplished without the immersion of the fabric in a liquid cleaning medium while it is subjected to the acoustic energy. This feature is important, inasmuch as the fabric is dry and ready for use immediately after cleaning is complete. The present approach may therefore be considered a dry-cleaning process, as distinct from a washing process wherein the fabric is immersed in a bath of a liquid cleaning medium, as in conventional tub washing of fabric in water. In the present approach, the fabric may be contacted with a liquid or even immersed in a liquid prior to the step of subjecting the fabric to acoustic energy, but it may not be immersed in a liquid during and simultaneously with the step of subjecting the fabric to acoustic energy.

The present approach provides a technique for dry-cleaning fabrics. The approach has enhanced effectiveness as compared with conventional techniques, and as compared with prior gas jet cleaning techniques. The acoustic energy vibrates the fabric to aid in the dislodging of soil from the fabric, and that same vibration aids in preventing redeposition of the soil back onto the fabric before the soil may be removed from the system, as by filtering. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
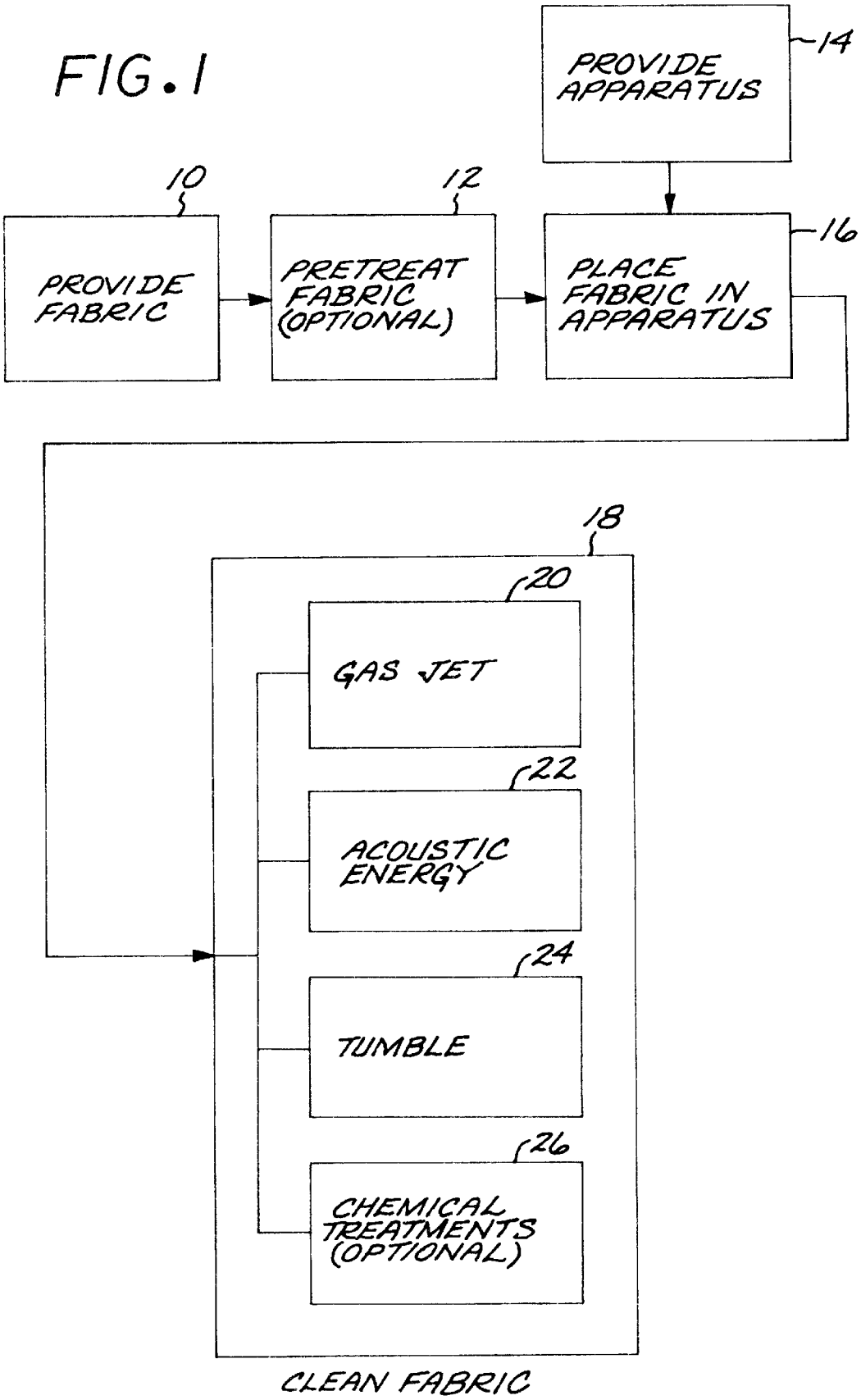
FIG. 1 is a block flow diagram of an approach for practicing the present invention.

FIG. 1 depicts a preferred approach for practicing the fabric cleaning method of the invention. A piece of fabric is provided, numeral 10. The fabric may be of any operable type, including both woven and nonwoven fibers. The fabric may be of a wide variety of weights and thread densities. Typically, the greater the weight and the greater the thread density, the greater the agitation required, and in a preferred case the higher the pressure drop across the gas jet nozzles utilized in a subsequent step. The fabric has soil adhered to the fibers of the fabric. As used herein, "soil" includes both particulate and non-particulate material.

The fabric may optionally be pretreated, numeral 12, as for example with a pretreatment chemical that loosens the particulate soil and/or a chemical that causes a non-particulate soil to become particulated. Either of these types of chemicals may be a generally acting chemical or a chemical that acts on specific types of soil (i.e., a "spotting" compound), and such chemicals are known for other applications. A colorless sulfonated dye site blocker such as those disclosed in U.S. Pat. Nos. 4,501,591; 4,592,940; 4,908,149; and 4,699,812 may be used to dislodge and particulate a specific stain. Examples of chemicals that loosen and particulate the soil are aliphatic sulfonic acid cleaning compounds, both alkyl and alkenyl, in the preferred range of C8–C24, as disclosed in U.S. Pat. No. 4,699,812. These chemicals are selected to be consistent with other features of the process, specifically safety, biodegradability, and environmental acceptability. The particulating chemicals are often furnished as liquids, but they are used only to moisten the fabric and not as a general cleaning medium as in a conventional water-immersion washing machine.

Another example of a chemical that may be applied to the fabric in the pretreatment step 12 is a foaming agent. Foaming agents are known for use in other applications. A preferred foaming agent is sodium lauroyl sarcosinate, marketed as Secosyl by Stephan Co. When a foaming agent is used, the foaming agent aids in floating the loosened soil to the surface of the fabric.

Yet another chemical agent which may be applied to the fabric in pretreatment step 12 alters the vibrational behavior of the fabric when subjected to an acoustic beam. Such a chemical agent may alter the effective weight, density, or size of the fibers of the fabric, so that they vibrate differently than untreated fibers. Care is taken so that such a chemical agent does not adversely affect the removal of soil from the fabric. Chemical agents that alter the vibrational characteristics of the fabric but do not prevent removal of soil typically deposit on the fibers of the fabric and change their mass and thence their vibrational characteristics. The pretreatment chemicals discussed above for use in step 12 may have this effect. Other chemical agents that alter the vibrational characteristics of fabric include antistatic agents and odorants. Examples of operable anti-static compounds include, but are not limited to, alcohol ethoxylates, alkylene glycol, or glycol esters. Examples of odorants include, but are not limited to, perfumes, and essential natural or synthetic oils.

Figure 2:
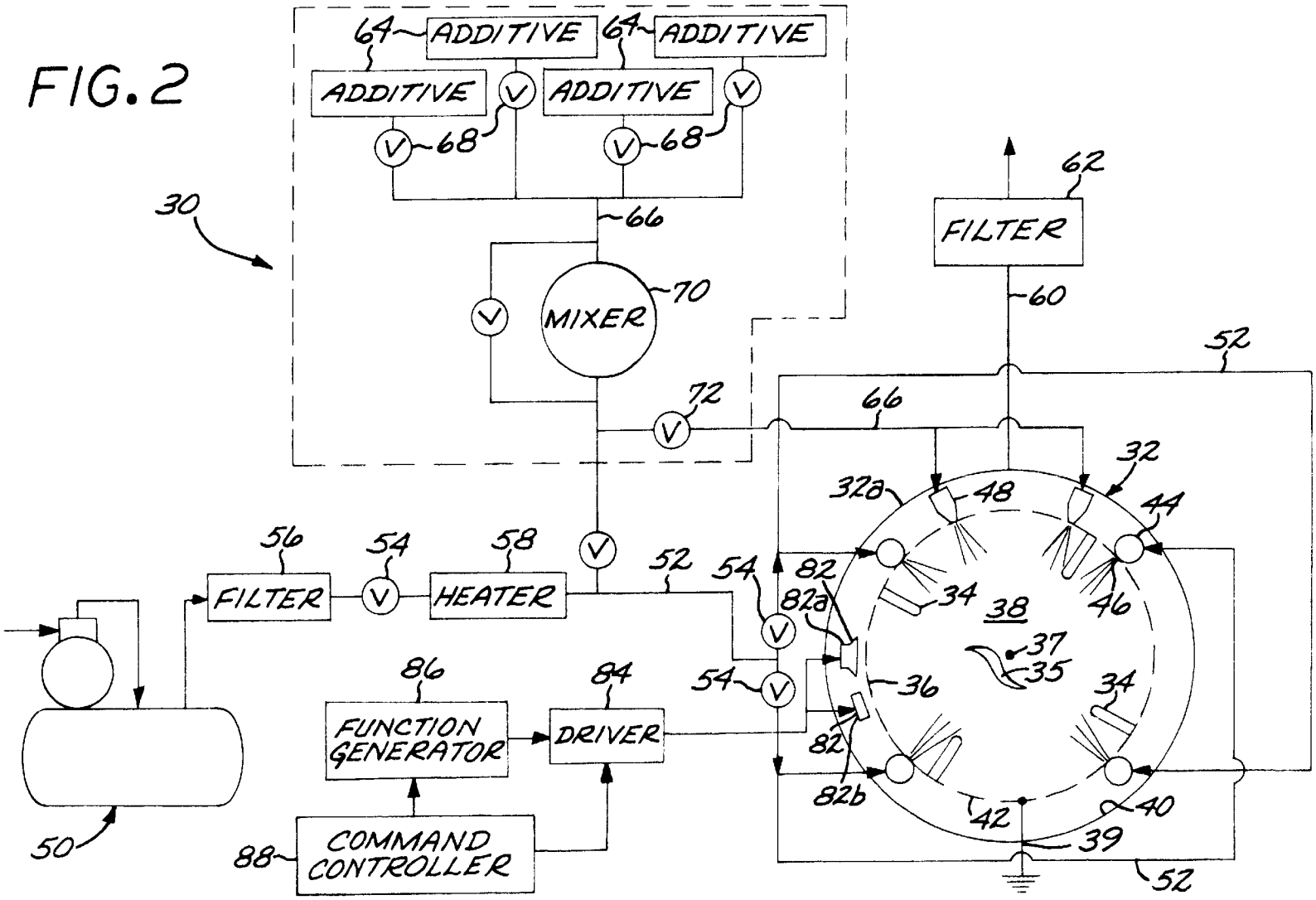
FIG. 2 is a diagrammatic view of an apparatus for practicing the present invention.

A cleaning apparatus is provided, numeral 14. FIG. 2 illustrates a preferred form of a cleaning apparatus 30, although other operable types of cleaning apparatus may also be used. The apparatus 30 includes a contacting chamber 32 with a perforated basket 36 therein. At least a portion of the wall of the contacting chamber 32 desirably includes a filter 32*a*. The perforated basket 36 is electrically grounded by a ground 39. The contacting chamber 32 and the perforated basket 36 are preferably cylindrical in cross section with a cylindrical axis 37 (extending out of the plane of the illustration). The perforated basket 36 is smaller in cylindrical diameter than the contacting chamber 32.

The piece of fabric 35 which is to be agitated is placed into an interior 38 of the perforated basket 36. There may also be provided a cabinet that encloses the contacting chamber 32, and an exterior door in the cabinet to allow access to the interior 38 of the perforated basket 36. Because the cleaning requires the use of ultrasonic energy within the cabinet, the walls of the cabinet and door may be insulated to prevent the acoustic energy from leaking to the exterior. Noise cancellation devices may also be used to acoustically insulate the cabinet.

The cleaning apparatus is provided with at least one device to mechanically agitate the fabric. The preferred apparatus 30 is provided with one or more sources of tumbling mechanical agitation, gas jet mechanical agitation, another approach to achieve mechanical agitation, and/or a combination of such mechanical agitation techniques. Two preferred techniques for mechanically agitating the fabric, tumbling and gas jet, are described in relation to the single preferred apparatus 30, but the invention is not so limited.

To achieve tumbling agitation, where provided, the perforated basket 36 is mounted on a rotational support for rotation about the cylindrical axis 37 and provided with a rotation drive motor to drive such rotation. The apparatus may also be provided with paddles 34 that project inwardly from the perforated basket 36 to contact the piece of fabric 35 within the perforated basket 36 during the cleaning operation. The rotation of the perforated basket 36 about the axis 37 and the contacting of the fabric 35 within the perforated basket 36 by the paddles 34 are included within the term "tumbling" as one approach to mechanically agitating the fabric. When such a rotational capability is provided, during the cleaning step of the present invention the perforated basket 36 may optionally be locked into a fixed position when the gas jets function, or the perforated basket 36 may be rotated while the gas jets function.

To achieve gas jet mechanical agitation, where provided, there is positioned between an inner surface 40 of the contacting chamber 32 and an outer surface 42 of the perforated basket 36 at least one, and preferably several, gas jet manifolds 44. In the preferred cylindrical design, the gas jet manifolds 44 extend parallel to the cylindrical axis 37. The manifolds 44 may be affixed to the outer surface 42 of the perforated basket 36, affixed to the inner surface 40 of the contacting chamber 32, or separately supported. Preferably, the manifolds 44 (or individual gas jets) are affixed to the inner surface 40 of the contacting chamber 32, or separately supported. A number of gas jet nozzles 46 are provided in each manifold, with the gas flows from the nozzles 46 directed inwardly into the interior 38 of the perforated basket 36 through the perforations. The manifolds 44 and gas jet nozzles 46 are positioned to promote reversible garment agitation to prevent garment roping, tangling, and strangling during cleaning. Rotation of the perforated basket 36 can also aid in this effort. During the cleaning operation, the soil-dislodging gas flows through the manifolds 44, through the nozzles 46, and into the interior 38 of the perforated basket 36 to contact the fabric 35.

Preferably, at least one injector 48 is also provided and directed inwardly into the interior 38 of the perforated basket 36 through the perforations. As with the manifolds 44, it is preferred that the injectors 48 are affixed to the inner surface 40 of the contacting chamber 32, with the flows from the injectors 48 directed through perforations in the perforated basket 36. Any additives, such as treatment chemicals of the same type as the pretreatment chemicals described above or of other types, that are contacted to the fabric during the cleaning step may be introduced through the injectors 48. Such additives may instead be entrained into the soil-dislodging gas and introduced through the nozzles 46.

The soil-dislodging gas is pressurized by a compressor 50 (or supplied from a pressurized gas bottle or condensed gas source, not shown) and supplied to the manifolds 44 through a first piping system 52. The first piping system 52 includes manually operated or processor-controlled valves 54 to distribute the gas flow and, optionally, a filter 56 to filter the incoming gas and a heater 58 to heat the incoming gas to a desired temperature. The soil-dislodging gas is pressurized by the compressor 50, flows through the first piping system 52 to the manifolds 44, is introduced into the interior 38 of the perforated basket 36 through the nozzles 46, and flows out of the contacting chamber 32 through an exit pipe 60 (after passing through the filter 32*a,* if provided). A particulate filter 62 removes the particulate from the gas flowing in the exit pipe 60, so that it is not released into the air and the environment.

Any operable soil dislodging gas may be used. Examples include air, nitrogen, oxygen, carbon dioxide, water, nitrogen oxide, carbon monoxide, chlorine, bromine, iodine, nitrous oxide, and sulfur dioxide, and mixtures thereof. Nitrogen, oxygen, or carbon dioxide, and their mixtures, are preferred. Air, which is principally a mixture of nitrogen and oxygen, is most preferred. The soil-dislodging gas is pressurized to an operable pressure, preferably from about 30 to about 300 pounds per square inch. However, the remainder of the interior 38 of the perforated basket 36 remains at atmospheric pressure, so that no pressure chamber is used.

Additives such as treatment chemicals, anti-static compounds, and/or odorizing compounds are supplied to the injectors 48 from additive sources 64 through a second piping system 66. As noted, these additives may have the additional effect of changing the acoustic vibrational characteristics of the fabric. The second piping system 66 includes manually operated or processor-controlled valves 68 to select the types and amounts of the additives, a mixer 70 as necessary, and manually operated or processor-controlled valves 72 to distribute the additives to the injectors 48 and/or to the manifolds 44 as desired. Any additives that are not reacted with the fabric 35 in the interior 38 of the perforated basket 36 leave the contacting chamber 32 through the exit pipe 60 and are entrapped in the exit filter 62.

The apparatus 30 further includes a source of acoustic energy 80. The source of acoustic energy preferably includes at least one acoustic device 82 which converts an electrical input signal into an acoustic output signal. The acoustic device 82 is positioned such that the acoustic signal is directed into the interior 38 of the perforated basket 36, into the volume occupied by fabric 35 during the cleaning operation. Preferably, the acoustic device 82 is affixed to the inner surface 40 of the contacting chamber 32, or separately supported. There may be multiple acoustic devices 82 positioned at various locations around the perforated basket 36.

The nature of the acoustic device 82 depends upon the frequency of the acoustic energy to be produced. As used herein, "acoustic" includes audible, ultrasonic, and megasonic energy having a frequency ranging from about 1 hertz to about 1 megahertz. (The terms "audible", "ultrasonic", and "megasonic" are sometimes defined as having numerical ranges slightly different from those set forth herein, but for the purposes of the present application the terms are defined as set forth next.) For example, if the frequency of the acoustic energy is in the audible range of from about 20 hertz to about 20 kilohertz (20,000 hertz), the acoustic device 82 would typically be a loudspeaker device 82*a* in which a coil drives a membrane. If the frequency of the acoustic energy is higher, in the ultrasonic range of from about 20 kilohertz up to about 150 kilohertz or the megasonic range of from about 150 kilohertz up to about 1 megahertz ($10^6$ hertz), the acoustic device 82 would typically be a transducer 82*b* such as a piezoelectric transducer. However, any other operable acoustic device may be used. Such acoustic devices are well known for use in other applications. Both types of acoustic devices 82*a* and 82*b* may be supplied for use in a single apparatus 30, so that acoustic energy of a wide range may be directed into the interior 38 of the perforated basket 36. If several types of acoustic devices 82 are provided in a single apparatus 30, they may be operated individually or at the same time, according to the requirements for optimally cleaning the fabric. Any of the acoustic devices 82 may be operated at a single frequency, a range of frequencies, or a number of discrete frequencies, or swept over a range of frequencies.

The electrical input signal to the acoustic device 82 is provided by an electrical source. The electrical source typically includes an appropriate driver 84, which provides an electrical signal of a selected amplitude and frequency. The driver 84 is selected according to the nature of the acoustic device 82, and there could be multiple drivers 84. The shape and frequency of the electrical signal of the driver 84 are typically defined by a function generator 86 that is also a part of the electrical source. The function generator 86 is controllable to select the shape and frequency of the signal of the driver 84, by a command controller 88 portion of the electrical source. The command controller 88 also typically controls the driver 84 as to the amplitude and on/off functions. The command controller 88 may be set manually and/or may include a microprocessor or other type of automated controller. A typical power level for the acoustic device would be 50 watts or larger, but the required power depends upon the size of the perforated basket 36 and the total mass of the fabric being processed.

Returning to FIG. 1, the fabric 35 is placed into the interior 38 of the perforated basket 36 of the apparatus 30, numeral 16. The apparatus 30 is then started, and cleaning is performed, numeral 18. The cleaning step 18 includes at least operation of the gas jets 46 (numeral 20) and/or the tumbling (numeral 24), and additionally the source of acoustic energy 80 (numeral 22). That is, the cleaning step includes one or more types of mechanical agitation and additionally acoustic excitation. The cleaning step 18 may also optionally include the addition of chemical treatments, such as the treatment chemicals, odorants, vibration-altering, and/or antistatic compounds discussed above, numeral 26.

The duration of the cleaning step 20 depends upon the nature of the apparatus used, the nature and extent of the soiling, and the size of the load of fabric being processed.

Typically for a normal load of fabric in the apparatus 30, the cleaning time is from about 30 seconds to about 5 minutes. This exposure time is considerably shorter than required for conventional dry cleaning or wet washing, and the fabric leaves the processing dry and fresh smelling.

Figure 3:
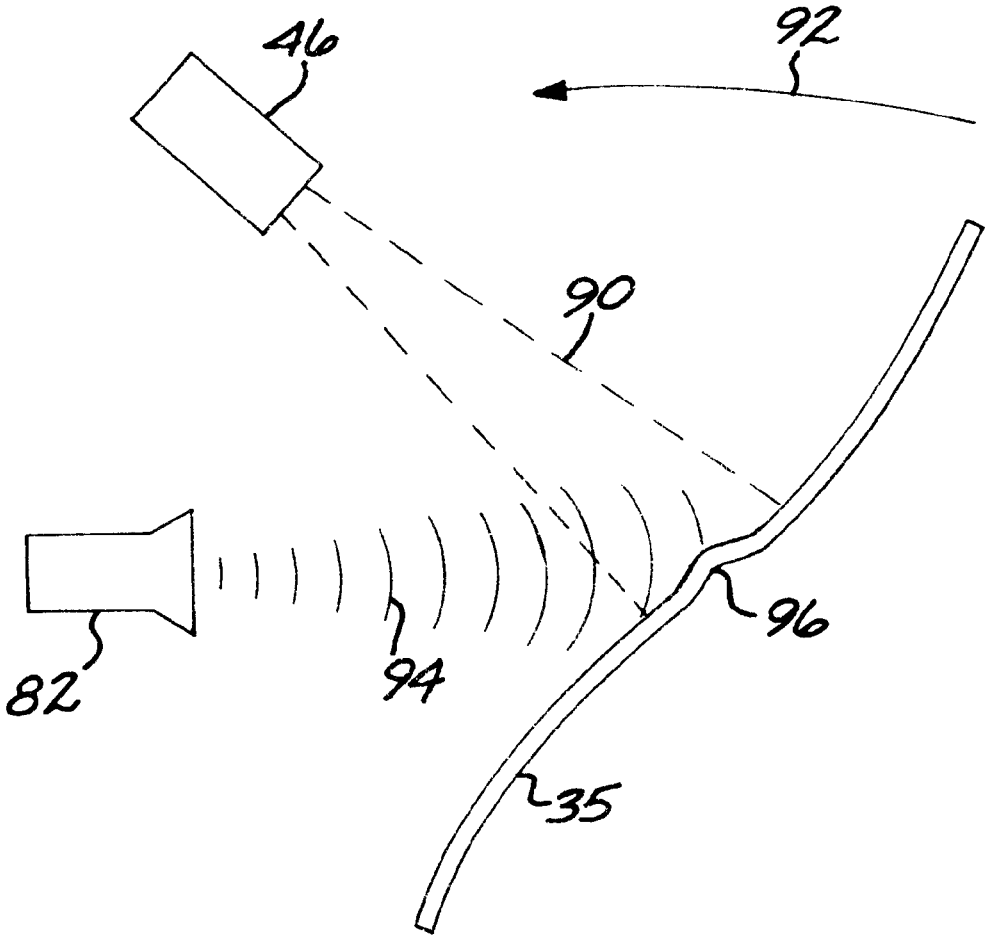
FIG. 3 schematically illustrates the dislodging mechanism of soil from fabric.

FIG. 3 schematically illustrates the mechanism of the cleaning process of step 18. In this preferred approach, the fabric 36 is contacted by a gas jet 90 from the nozzle 46 and at the same time tumbled, as represented by arrow 92, although alternatively only one of these mechanical agitation effects would be employed. The mechanical agitation is produced by a source of agitation other than the acoustic device 82. These mechanical agitation effects impart a macroscopic movement to the fibers of the fabric, which serve to dislodge soil from the fibers. The acoustic device 82 directs an acoustic beam 94 at the fabric 35. The acoustic beam 94 induces localized sympathetic transverse (i.e., bending and flexing) and longitudinal (i.e., stretching) vibrations along the length of the fibers of the fabric, as indicated at numeral 96. The combination of these mechanical and acoustic movements of the fibers of the fabric is more effective at dislodging soil from the fabric, and preventing its redeposition on the fabric, than the action of either the gas jet 90 acting alone, the tumbling 92 acting alone, or the combination of the gas jet and the tumbling acting together.

The soil-dislodging effects of the source of acoustic energy 80 may be optimized by adjusting the amplitude and the frequency of the acoustic beam 94, through controlling the driver 84 in the manner discussed above. In some situations, an optimum acoustic beam 94 may be known. In other situations, the best cleaning may be obtained by sweeping the acoustic beam 94 through a wide range of frequencies and amplitudes, thereby possibly necessitating the use of multiple acoustic devices 82 if no one type of device is capable of operating over the desired range of frequencies and amplitudes.

In all cases, the cleaning is necessarily accomplished without immersing the fabric in a liquid cleaning medium during the period when it is subjected to the acoustic beam. The present approach is distinct in respect to the absence of immersion of the fabric in any liquid cleaning medium and also the mechanism of the cleaning action by the acoustic energy. When a fabric in a liquid medium is subjected to an acoustic beam, there is a cavitation action that affects the fabric. In the present approach, the gaseous medium is of too low a density to cavitate in an acoustic beam, and instead the acoustic beam operates directly on the fabric to accomplish a sympathetic vibration.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for cleaning fabric, comprising the steps of:

providing a piece of fabric having soil therein;

providing a source of acoustic energy; and cleaning the piece of fabric in a gaseous environment wherein the piece of fabric is not immersed in a liquid cleaning medium, the step of cleaning including the steps of subjecting the piece of fabric to acoustic energy emitted from the source of acoustic energy, and, simultaneously, mechanically agitating the piece of fabric, wherein the step of agitating includes the step of contacting the piece of fabric with the jet of a soil-dislodging gas passed through a nozzle with a pressure drop of from about 30 to about 300 pounds per square inch.

2. The method of claim 1, wherein the source of acoustic energy comprises an acoustic device which converts an electrical input signal into an acoustic output signal.

3. The method of claim 2, wherein the source of acoustic energy further comprises an electrical source which provides the electrical input signal to the acoustic device.

4. The method of claim 2, wherein the source of acoustic energy further comprises a controllable function generator which provides the electrical input signal to the acoustic device.

5. The method of claim 1, wherein the acoustic energy has a frequency of from about 20 hertz to about 20 kilohertz.

6. The method of claim 1, wherein the acoustic energy has a frequency of from about 20 kilohertz to about 150 kilohertz.

7. The method of claim 1, wherein the acoustic energy has a frequency of from about 150 kilohertz to about 1 megahertz.

8. The method of claim 1, wherein the step of agitating includes the step of contacting the piece of fabric with a jet of a soil-dislodging gas to dislodge the soil therefrom.

9. The method of claim 8, wherein the soil-dislodging gas is selected from the group consisting of nitrogen, oxygen, carbon dioxide, and mixtures thereof.

10. The method of claim 8, wherein the soil-dislodging gas is air.

11. The method of claim 1, including an additional step, performed concurrently with the step of agitating, of tumbling the piece of fabric.

12. The method of claim 1, including an additional step, performed prior to the step of cleaning, of treating at least a portion of the piece of fabric with a mobilizing chemical that loosens the soil.

13. The method of claim 12, wherein the mobilizing chemical is a general effect chemical functional with a wide range of types of soils.

14. The method of claim 12, wherein the mobilizing chemical is a selective chemical operable with specific types of soils.

15. The method of claim 1, including an additional step, performed simultaneously with the step of cleaning, of contacting an anti-static compound to the piece of fabric.

16. A method for cleaning fabric, comprising the steps of:

providing a piece of fabric having soil therein;

providing a source of acoustic energy, the source of acoustic energy comprising an acoustic device which converts an input signal into an acoustic output signal; and cleaning the piece of fabric in a gaseous environment wherein the piece of fabric is not immersed in a liquid cleaning medium, the step of cleaning including the steps of mechanically agitating the piece of fabric with a jet of a soil-dislodging gas to dislodge the soil therefrom, and, simultaneously, subjecting the piece of fabric to acoustic energy emitted from the source of acoustic energy and directed by the source of acoustic energy at the piece of fabric.

17. The method of claim 16, wherein the step of agitating includes the step of contacting the piece of fabric with a jet of a soil-dislodging gas passed through a nozzle with a pressure drop of from about 30 to about 300 pounds per square inch.

18. The method of claim 16, including an additional step, performed concurrently with the step of mechanically agitating, of tumbling the piece of fabric.

19. The method of claim 16, including an additional step, performed prior to the step of cleaning, of pretreating at least a portion of the piece of fabric with a pretreatment chemical.

20. The method of claim 16, wherein the method further includes providing a basket in which the piece of fabric is placed, and wherein the step of subjecting includes the step of positioning the source of acoustic energy such that the acoustic energy is directed into an interior of the perforated basket and thence into the volume occupied by the piece of fabric.

21. The method of claim 16, wherein the step of providing the source of acoustic energy includes the step of providing a function generator which provides an electrical input signal to the acoustic device at a frequency of from about 1 hertz to about 1 megahertz.

* * * * *